US006105172A

United States Patent [19]

Shida

[11] Patent Number: 6,105,172

[45] Date of Patent: Aug. 22, 2000

[54] HELMET

[75] Inventor: Masayuki Shida, Chofu, Japan

[73] Assignee: Shoei Co., Ltd., Tokyo, Japan

[21] Appl. No.: 08/900,940

[22] Filed: Jul. 28, 1997

[30] Foreign Application Priority Data

Jul. 30, 1996 [JP] Japan ..... 8-216830

[51] Int. Cl.[7] ..... A42B 3/28

[52] U.S. Cl. ..... 2/171.3; 2/424

[58] Field of Search ..... 2/410, 411, 424, 2/414, 171.3

[56] References Cited

U.S. PATENT DOCUMENTS 5,058,212 10/1991 Kamata ..... 2/424
5,088,129 2/1992 Kamata ..... 2/411
5,093,938 3/1992 Kamata ..... 2/424
5,170,510 12/1992 Nava ..... 2/414
5,170,511 12/1992 Kamata ..... 2/424
5,345,614 9/1994 Tanaka ..... 2/425
5,694,650 12/1997 Hong ..... 2/424

*Primary Examiner*—Michael A. Neas
*Attorney, Agent, or Firm*—Hopgood, Calimafde, Kalil & Judlowe

[57] ABSTRACT

In accordance with one aspect of this invention, provided in the cap body of a helmet is an air exhaust passage, the foremost end of which is near the upper end of the inner surface of a shield plate and, in accordance with another aspect of this invention, both an air exhaust passage and an air supply passage are provided in the cap body of a helmet and both can open and close with a common shutter. According to this helmet, a draft necessary for the defogging of the inner surface of the shield plate, the ventilation of the inside of the cap body and so forth can be effectively produced despite its simple structure.

8 Claims, 10 Drawing Sheets

HELMET

TECHNICAL FIELD

This invention relates to a helmet having a head protector (hereinafter described only as a cap body), which is worn by a rider of a motorcycle or the like to protect his head, the cap body being provided with a ventilating mechanism (that is, a ventilator) for defogging the inner surface of a shield plate attached to the cap body, air-ventilating within the cap body or the like.

BACKGROUND OF THE INVENTION

Disclosed in Japanese Patent Publication No. 6-63125 is an example of a full-face-type helmet, in the cap body of which a ventilator is provided, as described above, for defogging the inner surface of a shield plate and for air-ventilating within the cap body.

The full-face-type helmet described in Japanese Patent Publication No. 6-63125 (hereinafter described only as a conventional helmet) has an upper ventilator and a lower ventilator provided above and below a window opening, respectively, the window opening being provided in the full-face-type cap body so as to be opposite to the face of a person with the helmet on, when the helmet is put on the head of the person with the helmet on, such as the rider of the motorcycle or the like (hereinafter described only as the rider or the like). The upper ventilator and the lower ventilator have an upper supply air passage and a lower supply air passage, respectively, which can open and close with an upper shutter member and a lower shutter member, respectively.

In the conventional helmet, thus, the inside of the cap body (that is, the structure within the cap body and/or the inner space for the head to be fitted) can be ventilated when the outer air is led therein under the open state of the upper supply passage and, under the open state of the lower supply passage, fogging the shield plate can be prevented due to the open air led into the cap body near the lower end of the inner surface of the shield plate, and flowed up along the inner surface of the shield plate.

However, in the conventional helmet constituted as described above, the outer air led into the cap body near the lower end of the inner surface of the shield plate through the lower supply passage is not only flowed up along the inner surface of the shield plate. A considerable part of the outer air is naturally diffused wide in the cap body, so that the defogging of the shield plate becomes insufficient. Thus, in the conventional helmet, fogging the shield plate can not effectively be prevented in the humid rainy weather.

SUMMARY OF THE INVENTION

Accordingly, it is an object of this invention to provide a helmet in which the air that stagnates near the upper end of the inner surface of the shield plate is forcibly exhausted outside through an air exhaust passage to enable the air to flow smoothly along the inner surface of the shield plate, so that fogging the shield plate can be very effectively prevented by the help of a very simple constitution.

Another object of this invention is to provide a helmet in which when necessary, a common shutter member can be operated to enable the respective air exhaust and air supply passages to open or close selectively and, when necessary, not only the air within the cap body can be forcibly exhausted outside through the air exhaust passage, but also the outer air can be forcibly led into the cap body through the air supply passage, so that fogging the inner surface of the shield plate can be very effectively prevented and the ventilation or the like of the inside of the cap body can be much improved by the help of a very simple constitution.

In accordance with one aspect of this invention, a helmet comprises a cap body, and a shield plate attached to the cap body so as to cover at least partially an area which extends in opposite to the face of a person with the helmet on, wherein an air exhaust passage, the foremost end of which is near the upper end of the inner surface of the shield plate, is provided in the cap body.

In that event, it is preferable further to provide an air supply passage in the cap body, the rearmost end of which is near an area of the inside of the cap body, the area extending in opposite to the forehead of a person with the helmet on, and to have both the air exhaust passage and the air supply passage opened or closed with a common shutter member.

It is preferable to enable the shutter member to hold at least in three positions: the first position where both the air exhaust passage and the air supply passage are opened; the second position where the air exhaust passage is opened and the air supply passage is closed; and the third position where both the air exhaust passage and the air supply passage are closed.

Moreover, it is preferable for the cap body to be a full-face-type, to provide a second air supply passage in the cap body so that the rearmost end of the air supply passage may be near the lower end of the inner surface of the shield plate, and to enable a second shutter member to open and close the second air supply passage.

In accordance with another aspect of this invention, a helmet has an air exhaust passage having a first foremost end near to the outside of a cap body and a first rearmost end in the inside (that is, the structure within the cap body and/or the inner space for the head to be fitted) of the cap body; and an air supply passage having a second foremost end in the inside of the cap body and a second rearmost end near to the outside of the cap body, and both the air exhaust passage and the air supply passage can open and close with a common shutter member.

In that event, it is preferable to enable the shutter member to hold at least in three positions: the first position where both the air exhaust passage and the air supply passage are opened; the second position where the air exhaust passage is opened and the air supply passage is closed; and the third position where both the air exhaust passage and the air supply passage are closed.

It is preferable to attach an air-inlet-and-outlet forming member, the shutter member and a cover member to the cap body; to provide an air exhaust opening, which constitutes a part of the air exhaust passage, and an air supply opening, which constitutes a part of the air supply passage, in the air-inlet-and-outlet forming member; to make the shutter member movable in relative relation with the air-inlet-and-outlet forming member to open and close the air exhaust opening and the air supply opening; and to have the air exhaust opening covered with the cover member so as to constitute at least a part of the rearmost end of the air exhaust passage.

Moreover, it is preferable to form the first rearmost end of the air exhaust passage out of a gap defined by the cover member and the outer surface of the cap body.

Moreover, it is preferable that the angle of inclination of the outer edge of the air exhaust opening, which comprises the gap and is the rearmost end of the air exhaust passage, to the moving direction D, which generally indicates the relative flow of the open air, is within the range of 5–40°, and it is much preferable that the angle is within the range of 10–30°.

The above, and other, objects, features and advantages of this invention, will become readily apparent from the following detailed description thereof which is to be read in connection with the accompanying drawings.

DETAILED DESCRIPTION OF THE INVENTION

Referring to FIGS. 1–11, an embodiment of this invention applied to a full-face-type helmet will be described.

Figure 1:
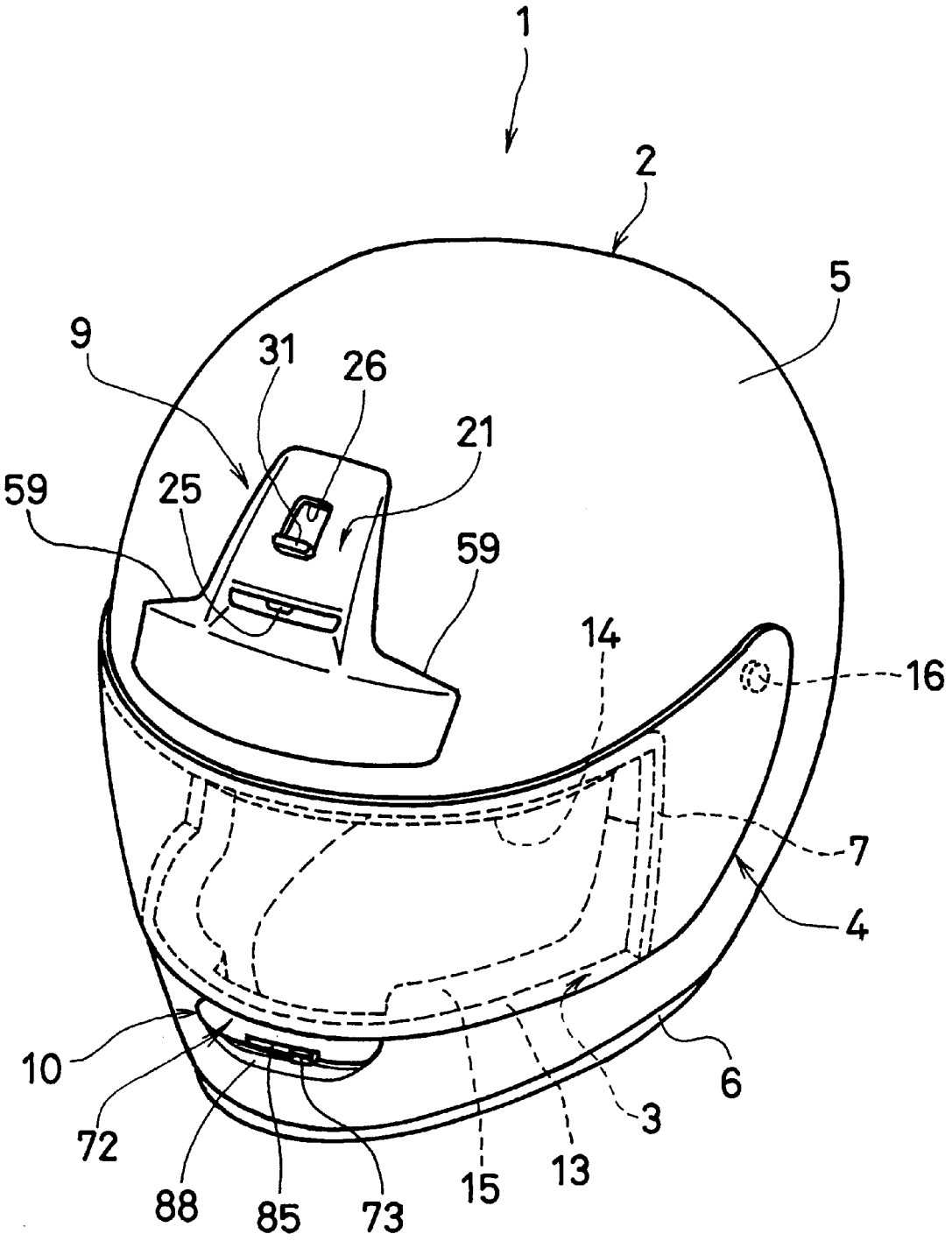
FIG. 1 is a perspective view of a helmet according to an embodiment of this invention, in which the invention is applied to a full-face-type helmet.

As shown in FIG. 1, a full-face-type helmet 1 comprises a cap body 2 to be put on the head of the rider or the like; a shield plate 4 capable of opening and closing a window opening 3, which is provided in the front surface of the cap body 2 so as to be at least partially in opposite to a portion between the rider or the like's forehead and chin (that is, the rider or the like's face); and a pair of right and left chin straps attached to the inside of the cap body 2. The pair of chin straps are not shown in FIG. 1, because they have been accommodated in the inside of the cap body 2. The straps may be the well-known conventional ones. An upper ventilator 9 is provided in at least a part of an area (which is in opposite to the rider or the like's forehead) and its circumference of the cap body 2, and a lower ventilator 10 is provided in at least a part of an area (which is in opposite to the rider or the like's chin) and its circumference of the cap body 2. It is noted that the cap body 2 may have a well-known constitution if its portions relating to the upper ventilator and the lower ventilator are excluded.

Figure 8A:
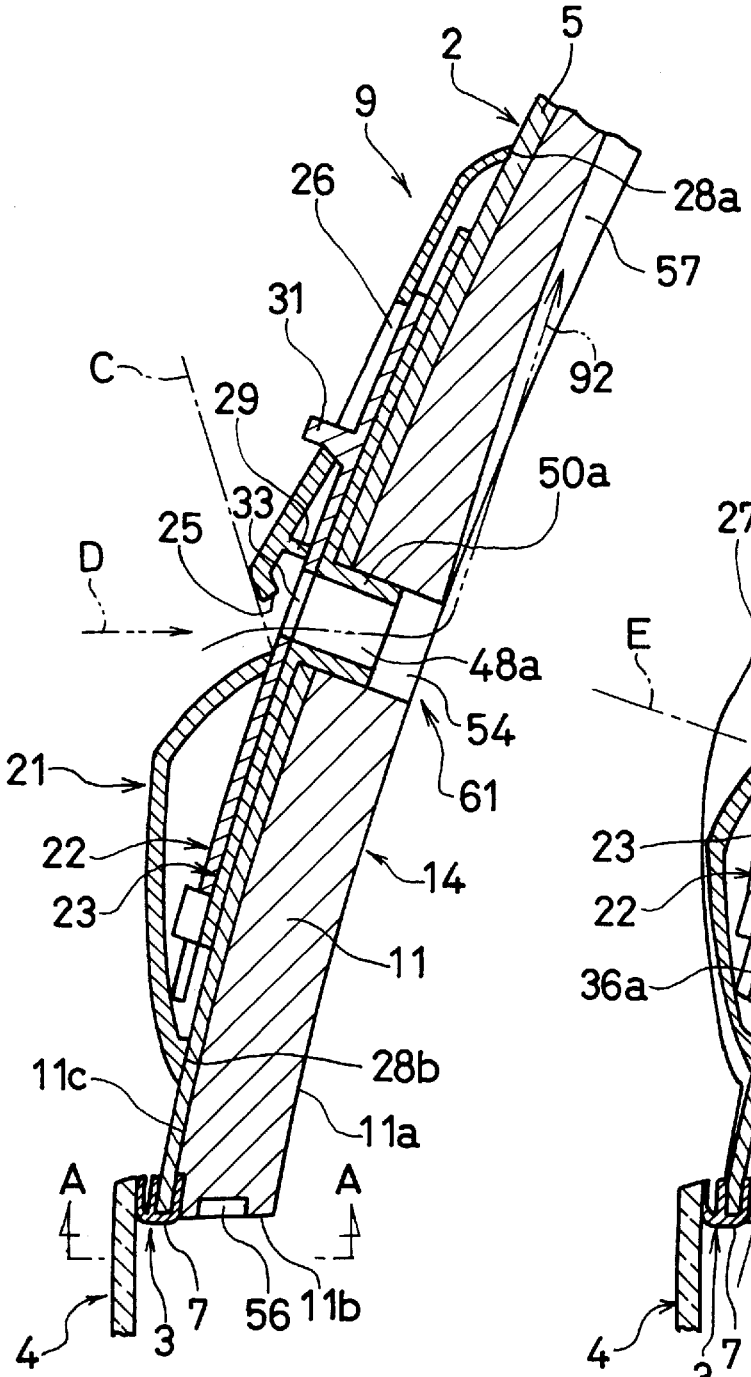
FIG. 8*a* is an enlarged, sectional view of the upper ventilator and its circumference shown in FIG. 6.
Figure 8B:
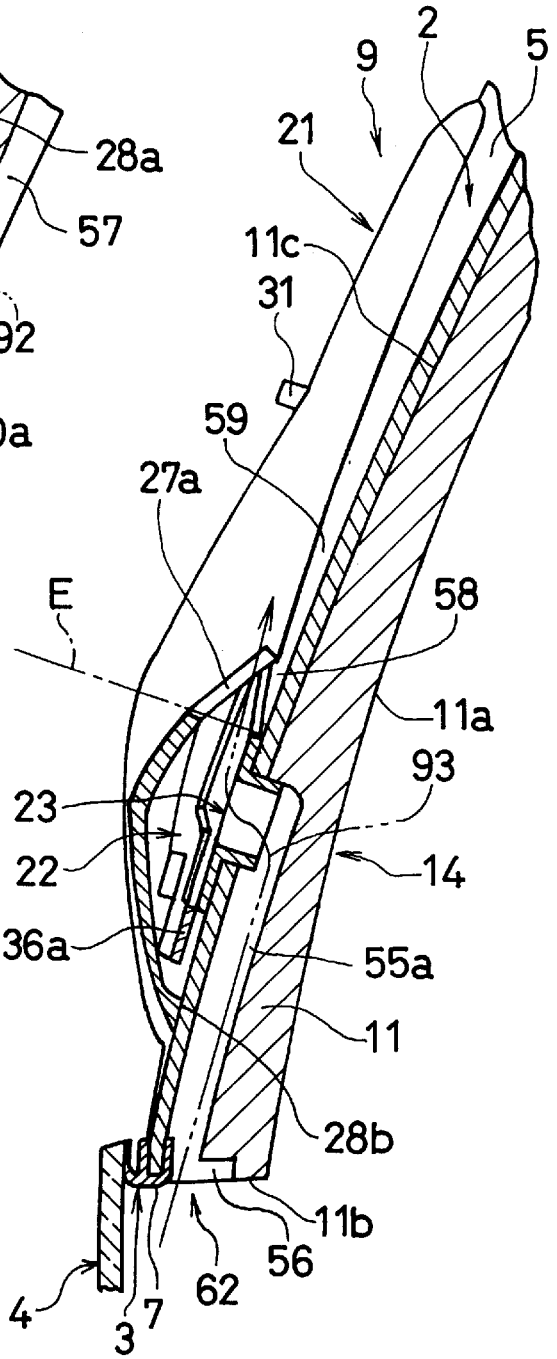
FIG. 8*b* is an enlarged, sectional view of the lower ventilator and its circumference shown in FIG. 7.
Figure 9:
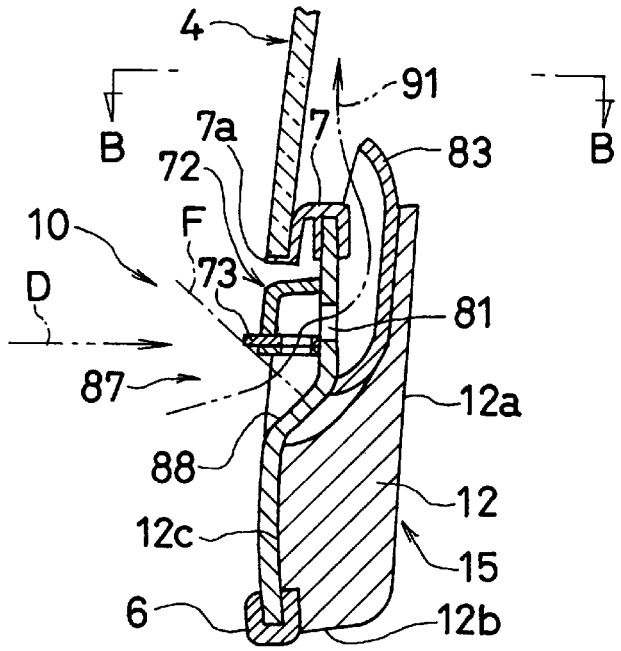
FIG. 9 is an enlarged, sectional view of the lower ventilator and its circumference shown in FIGS. 6 and 7.
Figure 10A:
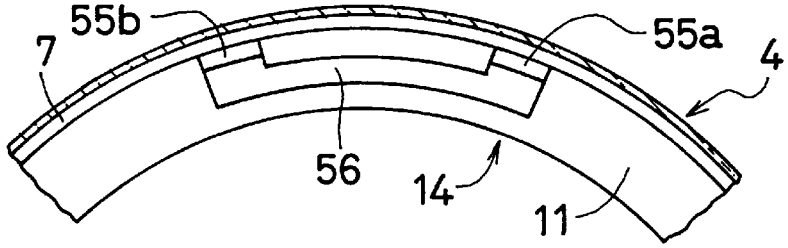
FIG. 10*a* is a sectional view taken along the line A—A on FIG. 8*a;*
Figure 10B:
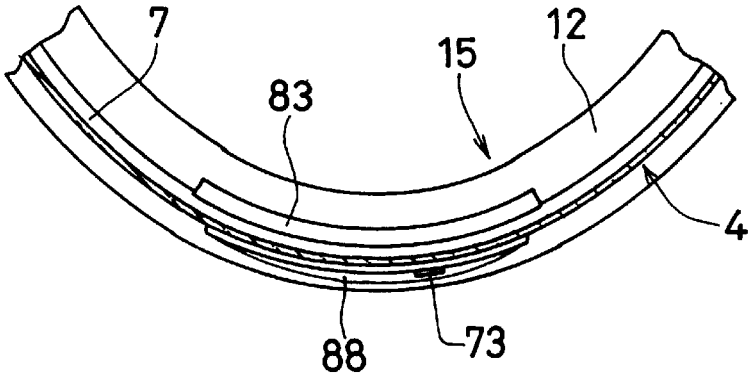
FIG. 10*b* is a sectional view taken along the line B—B on FIG. 9.

Thus, the cap body 2 may comprise, as shown in FIGS. 1, 8, 9 and 10, a full-face-type outer shell 5, which is the outer wall of the cap body 2; a lower rim member 6, which is secured all around the lower end of the outer shell 5 with an adhesive or the like and has substantially the shape of the letter "U" in section; a rim member 7 for a window opening, which is secured all around the window opening 13 of the outer shell 5 with an adhesive or the like and has substantially the shape of the letter "E" in section; a backing member 14 for the head, which abuts on an area of the inner surface of the outer shell 5 and is fixed thereto with an adhesive or the like, the area of the inner surface of the outer shell 5 being in opposite to the forehead, the crown of head, both sides of the head, and the back of the head of the rider or the like; and a backing member 15 for the chin, which abuts on an area of the inner surface of the outer shell 5 and is fixed thereto with an adhesive or the like, the area of the inner surface being in opposite to the chin and the cheek of the rider or the like. The outer shell 5 may be made of composite material, comprising a high-strength shell body made of hard resin, such as FRP or the like, and a soft sheet of unwoven fabric or the like, with which the inner surface of the shell body is backed. The lower rim member may be made of soft resin, such as foamed vinyl chloride, synthetic rubber or the like. The rim member 7 for the window opening may be made of flexible elastic material, such as synthetic rubber or the like. As shown in FIG. 9, a nose 7*a* that protrudes outwards from the lower edge of the rim member 7 for the window opening may be formed integrally with the rim member 7 for the window opening so as to make the lower end of the shield plate 4 abut on the nose 7*a*.

Figure 5:
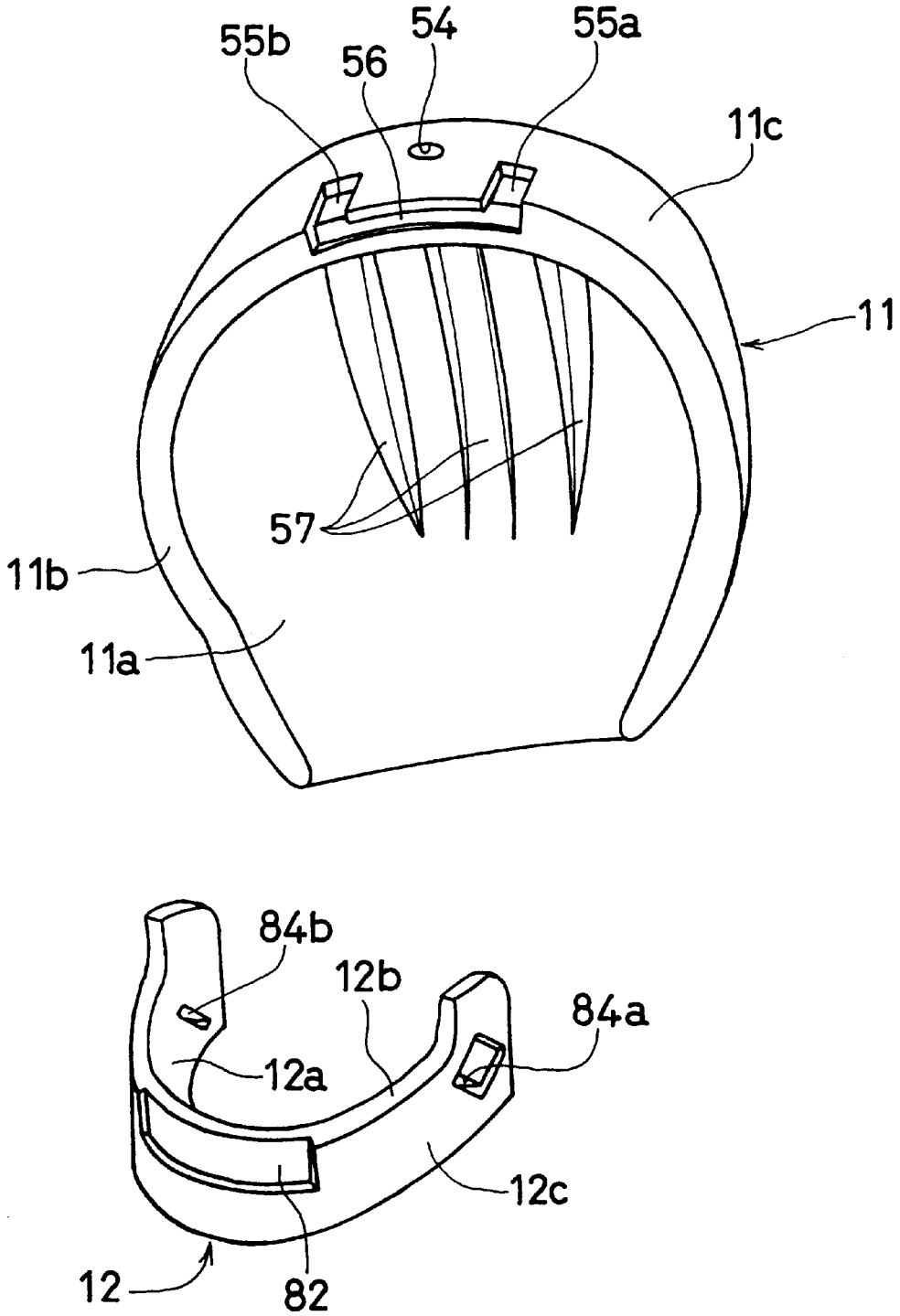
FIG. 5 is an exploded, perspective view of the impact-on-the-head absorbing liner and the impact-on-the-chin absorbing liner of the helmet of FIG. 1.

The backing member 14 for the head may comprise an impact-on-the-head absorbing liner 11 shown in FIG. 5; and an air-permeable backing cover (not shown) for the head, which is fixed to the liner 11 with an adhesive or a sticky tape so as to cover the inner surface of the liner 11 excepting a part of the top portion thereof; all the side surface 11*b* (that is, the narrow surface lying between the inner surface 11*a* and the outer surface 11*c* of the liner 11); and the periphery of the outer surface 11*c* which connects to the side surface 11*b*. It is noted that the air-permeable backing cover may be a conventional one. The backing member 15 for the chin (FIGS. 9 and 10*b*) may comprise the impact-on-the-chin absorbing liner 12 shown in FIG. 5; a pair of right and left blockish pads (not shown, they may be the conventional ones), which abut on an area, facing the rider or the like's respective cheeks, of the inner surface 12*a* of the liner 12 and is fixed thereto with an adhesive or the like; an air-permeable backing cover for the chin (not shown, it may be the conventional one), which covers the inner surface (excluding the portion facing the center portion of the rider or the like's chin), the side surface, and the periphery of the outer surface, connecting to the side surface, of a combined body, which comprises the pair of blockish pads and the liner 12, and is fixed thereto with an adhesive or a sticky tape; and a soft sheet (not shown, it may be the conventional one), which covers, within range of an area facing the rider or the like's chin, the inner surface 12*a*, the side surface 12*b*, and the periphery of the outer surface 12*c*, connecting to the side surface 12*b*, of the impact-on-the-chin absorbing liner 12 and is fixed thereto with an adhesive or the like.

Thus, the impact-on-the-head absorbing liner 11 and the impact-on-the-chin absorbing liner 12 may be made of synthetic resin or the like, such as foamed polystylen or the like, having suitable rigidity and plasticity, and the pair of blockish pads may be made of synthetic resin or the like, such as urethane foam, having softness and elasticity. Further, the respective surfaces of the backing covers for the head and the chin may be made of porous unwoven fabric, and the surface of porous unwoven fabric, which face the blockish pads, liner 11, or liner 12, is superposed by layers of elastic material rich in softness, such as urethane foam or other synthetic resin, are formed. Furthermore, the soft sheet of the backing member 15 for the chin may be formed out of nonporous material, such as synthetic leather backed with a foamed polyethylene sheet or the like, or soft resin.

The shield plate 4 is rotatably secured to the cap body 2 with a pair of right and left screws 16 so as to close the window opening 3 in its backward position, to open the window opening 3 when swings upwards from the backward position to its forward position, and to partly open the window opening 3 when the shield plate 4 lies between the forward position and the backward position. The shield plate 4 may be made of transparent or translucent hard material, such as polycarbonate or other synthetic resin.

Figure 2:
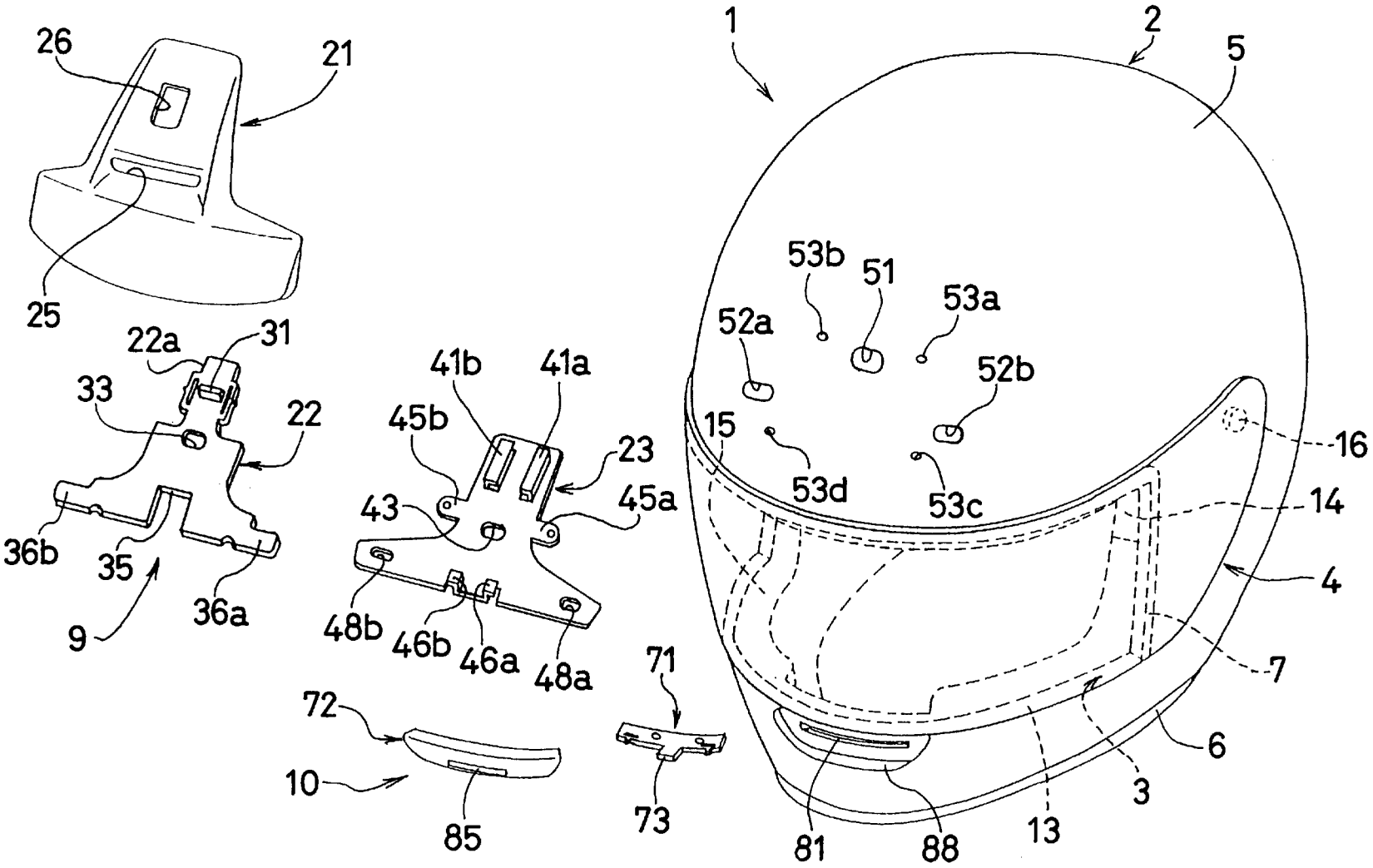
FIG. 2 is a perspective view, viewed from the front side, of the helmet shown in FIG. 1, in which an upper ventilator comprising three parts and a lower ventilator comprising two parts are shown separately.
Figure 3:
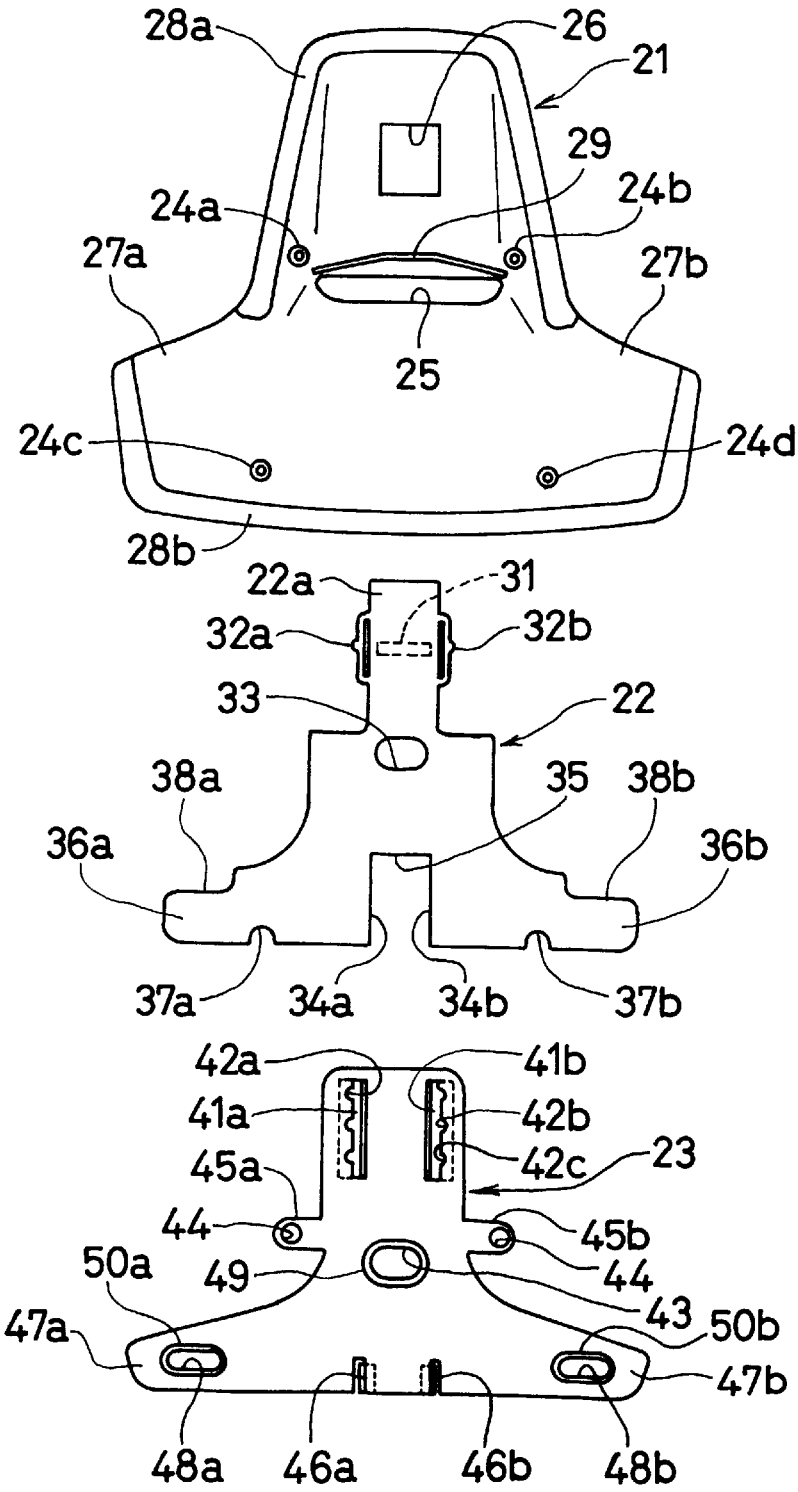
FIG. 3 is an exploded, rear view of the upper ventilator of FIG. 2, comprising the three parts.

As shown in FIGS. 2 and 3, the upper ventilator 9 has three upper-ventilator forming members: a cover member 21, a shutter member 22, and an air-inlet-and-outlet forming member 23. These three upper-ventilator forming members may be made of such material as to have suitable elasticity and suitable rigidity, such as polycarbonate, polyacetal, ABS, nylon or other synthetic resin. For example, these three upper-ventilator forming members may be all made of polycarbonate, or these three members may be mutually made of different materials: the cover member 21 of polycarbonate, the shutter member 22 of polyacetal, ABS, or nylon, and the air-inlet-and-outlet forming member 23 of polyacetal, ABS, or nylon.

As shown in FIG. 3, a plurality of fitting pins, for example, four pins 24*a*, 24*b*, 24*c* and 24*d* are formed integrally with the cover member 21 in its rear surface. In addition, the cover member 21 has an air inlet 25 that substantially laterally extends like a slit in the central portion thereof, and an opening 26 for inserting an operating tab 31 (hereinafter described) in the upper portion thereof. Further, in the rear surface of the cover member 21, a partition wall 29 that extends substantially along the upper edge of the air inlet 25 is formed integrally with the cover member 21. Furthermore, a pair of upper and lower abutments 28*a*, 28*b*, which are separated from each other in the right and left ends thereof with right and left interrupted portions 27*a*, 27*b* that are each a part of the periphery of the rear surface, are provided on the outer periphery of the rear surface of the cover member 21. It is noted that the partition wall 29 has a function of preventing the open air, flowing through the air inlet 25, from flowing in the upward direction.

Figure 6:
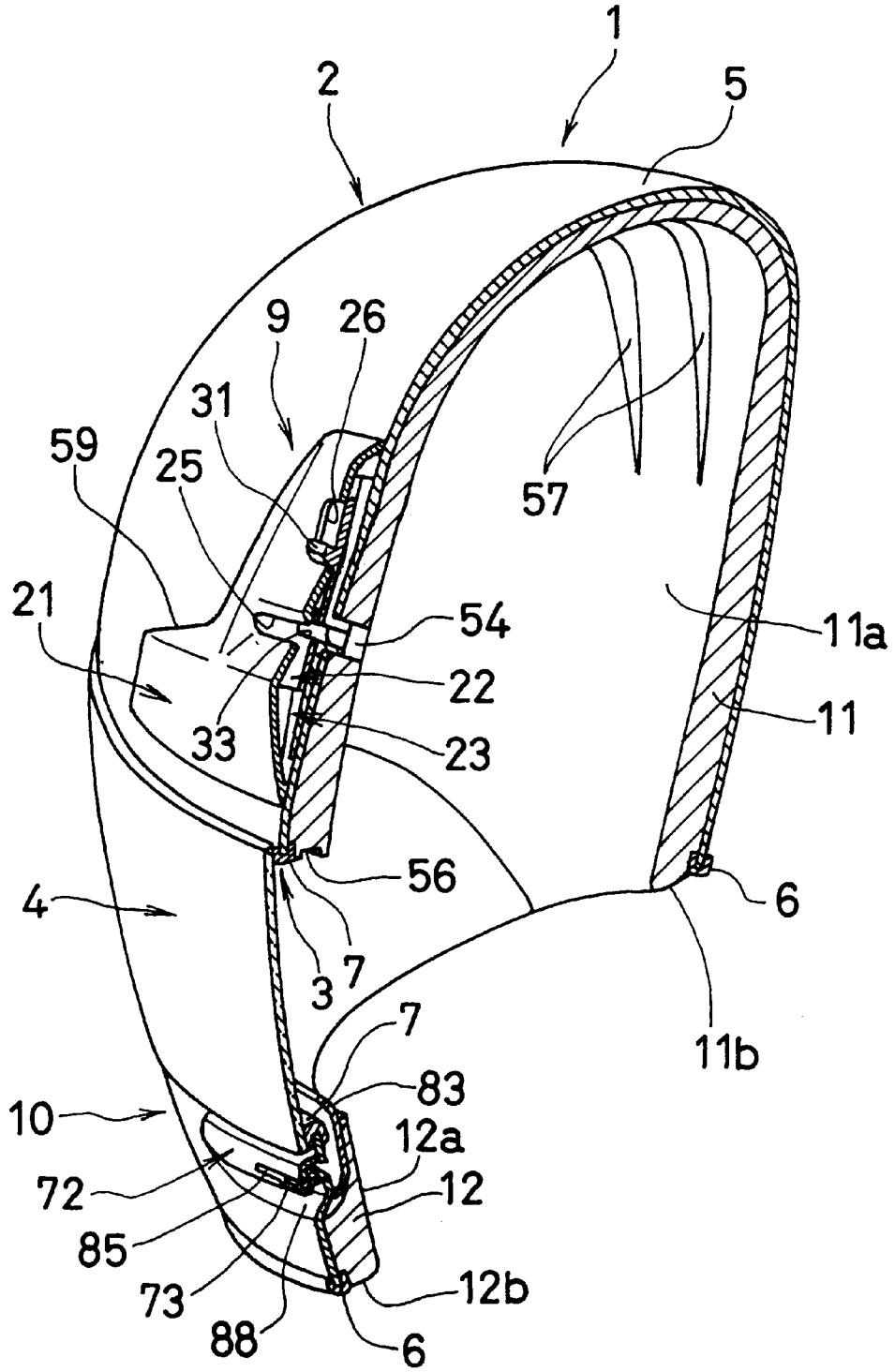
FIG. 6 is a perspective view, sectioned substantially in the central portion, of the helmet of FIG. 1, in which miscellaneous kinds of members attached to the impact-on-the-head absorbing liner and the impact-on-the-chin absorbing liner are omitted.
Figure 7:
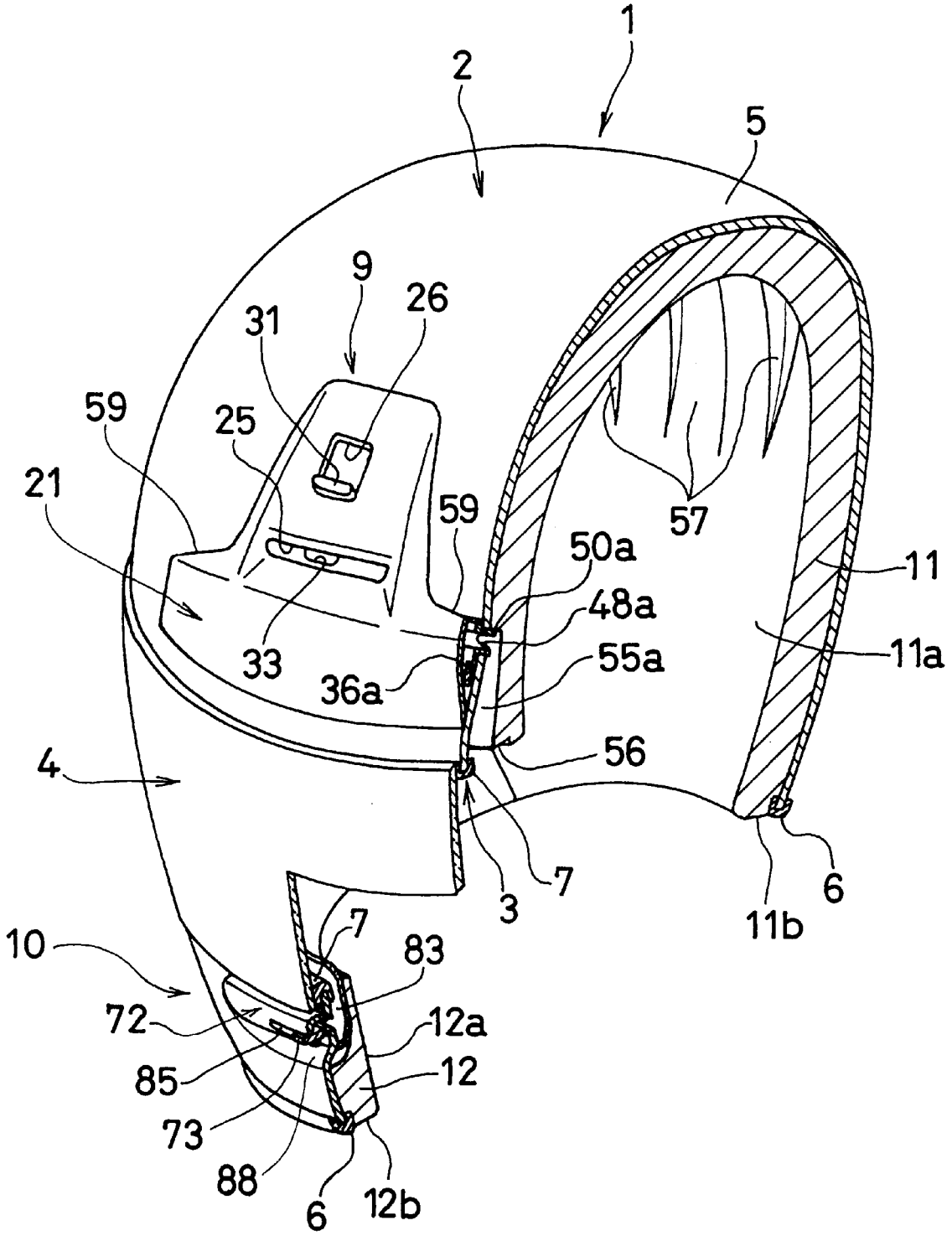
FIG. 7 is a perspective view, sectioned in a portion being to the right of the central portion of the helmet when the helmet of FIG. 1 is in the same situation as that of the helmet shown in FIG. 6.

As shown in FIGS. 3 and 6, the operating tab 31 provided for corresponding to the opening 26 of the cover member 21 is formed integrally with the shutter member 22 in the front surface thereof and, substantially on the right and left sides of the operating tab 31, a pair of protruding elastic clicks 32*a*, 32*b* are formed integrally with the shutter member 22. In the central portion of the shutter member 22, an air supply opening 33, for example, a laterally elliptical opening is provided for substantially corresponding to the air inlet 25 of the cover member 21 and, in the lower central portion of the shutter member 22, a cutout, for example, a rectangular cutout is provided to form a pair of right and left sliding portions 34*a*, 34*b*. Further, a pair of covering arms 36*a* and 36*b* positioned substantially on the right and left sides of the cutout 35, respectively, are formed integrally with the shutter member 22 and, in the lower ends of the covering arms 36*a* and 36*b*, respective escaping cutouts 37*a* and 37*b*, for example, substantially semicircular cutouts are formed so as to correspond to the pair of right and left fitting pins 24*c* and 24*d* that are provided in the lower portion of the cover member 21. On the other, in the upper ends of the covering arms 36*a* and 36*b*, a pair of right and left notches 38*a* and 38*b* for exhausting the air are formed, respectively.

As shown in FIG. 3, a pair of right and left channel-like guide portions 41*a* and 41*b* are formed integrally with the air-inlet-and-outlet forming member 23 to guide the protruding elastic clicks 32*a*, 32*b*. Each guide portion 41*a*, 41*b* is of L-shape in section and protrudes vertically from the member 23 in a position adjacent to the side edge, far from the center line of the member 23, of a rectangular slit. The slit is provided in the member 23 so as to extend in parallel with the center line of the member 23, and the upper end of each guide portion 41*a*, 41*b* extends above the rectangular slit in parallel therewith. In each side edge, far from the center line of the member 23, of the rectangular slit, for example, an upper recess 42*a*, an intermediate recess 42*b*, and a lower recess 42*c* are provided to enable the click 32*a*, 32*b* to engage therewith. Further, an air supply opening 43 similar to the air supply opening 33 of the shutter member 22 is provided in the central portion of the air-inlet-and-outlet forming member 23 so as to correspond to the opening 33 of the shutter member 22 and, along the periphery of the air supply opening 43, a tubularly projected wall 49 is formed integrally with the air-inlet-and-outlet forming member 23 in the rear surface thereof. Moreover, formed integrally with the air-inlet-and-outlet forming member 23 are a pair of right and left engaging arms 45*a* and 45*b* provided near the right and left sides of the air supply opening 43, respectively, and each having an fitted aperture 44. The respective apertures 44 corresponds to the fitting pin 24*a*, 24*b* of the cover member 21.

As shown in FIG. 3, a pair of right and left channel-like guide portions 46*a* and 46*b* are formed integrally with the lower portion of the air-inlet-and-outlet forming member 23 so as substantially to correspond to the pair of right and left sliding portions 34*a* and 34*b* of the shutter member 22. Each guide portion 46*a*, 46*b* is of L-shape in section and protrudes vertically from the member 23. A pair of right and left arm portions 47*a* and 47*b* extending laterally outward from the respective guide portions 46*a* and 46*b* are also formed integrally with the air-inlet-and-outlet forming member 23. Further, a pair of right and left air exhaust openings 48*a* and 48*b*, which are formed so as to correspond to the pair of right and left notches 38*a* and 38*b* for exhausting the air, are formed in the arm portions 47*a* and 47*b* and, along the periphery of each air exhaust opening 48*a*, 48*b*, a projected wall 50*a*, 50*b* is formed integrally with the air-inlet-and-outlet forming member 23 in the rear surface thereof.

As shown in FIG. 2, an air supply opening 51 and a pair of right and left air exhaust openings 52*a* and 52*b* are provided in a part of an area (facing the forehead of the rider or the like) and its circumference of the outer shell 5 so as to correspond to the air supply opening 43 and the pair of right and left air exhaust openings 48*a* and 48*b*, respectively. Further, fitting apertures 53*a*, 53*b*, 53*c* and 53*d*, which correspond to the respective fitting pins 24*a*, 24*b*, 24*c* and 24*d* of the cover member 21, are provided there. As shown in FIG. 5, in a part of an area (facing the rider or the like's forehead) and its circumference of the impact-on-the-head absorbing liner 11, an air supply opening 54 is formed to substantially correspond to the air supply opening 51 of the outer shell 5 and, in the part of the area and its circumference of the liner 11, longitudinal grooves 55*a* and 55*b* for air exhaust, which open to its outer surface 11*c*, are formed so as to correspond to the respective air exhaust openings 52*a* and 52*b* of the outer shell 5. Further, in the side surface 11*b* of the impact-on-the-head absorbing liner 11 (that is, in the narrow surface lying between the outer surface 11*c* and the inner surface 11*a* of the liner 11), a lateral groove 56 is formed to communicate with the longitudinal grooves 55*a* and 55*b*. Moreover, to improve the air ventilation within the liner 11, a plurality of grooves 57, for example, three grooves for air ventilation are formed to extend longitudinally along the inner surface 11*a* of the liner 11 in the top portion thereof. It is noted that, if necessary, the grooves 57 can be omitted.

The procedure of assembling the three upper-ventilator forming members (that is, the cover member 21, shutter member 22, and the air-inlet-and-outlet forming member 23) onto the cap body 2 as shown in FIG. 8 may be performed in the following numerical order.

(1) The narrow and substantially rectangular upper portion 22*a* of the shutter member 22, where the operating tab 31 and the protruding clicks 32*a* and 32*b* have been formed, is inserted into the channel-like guide portions 41*a* and 41*b* of the air-inlet-and-outlet forming member 23 from the underneath thereof and slid upwards till the protruding clicks 32*a* and 32*b* are fitted into the pair of right and left upper recesses 42*a*, respectively. Thereafter, the shutter member 22 is inclined a little in a right or left direction to fit one of the right and left sliding portions 34*a* and 34*b* of the shutter member 22 into one of the pair of channel-like guide portions 46*a* and 46*b* of the air-inlet-and-outlet forming member 23, which corresponds to the above sliding portion 34*a* or 34*b*, and the other of the sliding portion 34*a* or 34*b* is forcibly fitted into the other of the guide portion 46*a* or 46*b* of the air-inlet-and-outlet forming member 23 due to the elastic deformation of the shutter member 22. Thus, the shutter member 22 can slide up and down in the air-inlet-and-outlet forming member 23.

(2) Thereafter, the fitting pins 24*a* and 24*b* of the cover member 21 are fitted into the pair of right and left fitted apertures 44 that are formed in the respective right and left engaging arms 45*a* and 45*b*. Thereby, it is possible to secure the air-inlet-and-outlet forming member 23, which has been put together with the shutter member 22, to the cover member 21. In that event, the operating tab 31 of the shutter member 22 is in such a state as to pass through the opening 26 and protrude from the outer surface of the cover member 21. When the shutter member 22 is moved downwards and the pair of protruding clicks 32*a* and 32*b* are fitted into the pair of right and left lower recesses 42*c*, respectively, the pair of right and left fitting pins 24*c* and 24*d* of the cover member 21 are fitted into the pair of right and left escaping cutouts 37*a* and 37*b* of shutter member 22, respectively.

(3) After applying an adhesive to or put a duplex sticky tape between the pair of upper and lower abutments 28*a* and 28*b* of the cover member 21, the fitting pins 24*a*–24*d* of the cover member 21 are fitted into the respective fitting apertures 53*a*–53*d* of the outer shell 5 and, at the same time, the projected walls 49, 50*a* and 50*b* of the air-inlet-and-outlet forming member 23 are fitted into the air supply opening 51 and the air exhaust openings 52*a* and 52*b* of the outer shell 5, respectively. Thereafter, the abutments 28*a* and 28*b* are pressed against an area, facing the rider or the like's forehead, of the outer surface of the outer shell 5 so as to be stuck thereon. In that event, the distal ends of the projected walls 49, 50*a*, and 50*b* of the air-inlet-and-outlet forming member 23 are inserted into the air supply opening 55 and the air exhaust openings 55*a* and 55*b* of the impact-on-the-head absorbing liner 11 as shown in FIG. 8, respectively. Thus, the cover member 21, which has been put together with the shutter member 22 and the air-inlet-and-outlet forming member 23, can be secured to the outer shell 5, so that the cover member 21 has also the functions of positioning the air-inlet-and-outlet forming member 23 and securing it to the cap body 2. In that event, if retaining rings (not shown) are fitted into the respective distal ends of the fitting pins 24*a*–24*d* of the cover member 21, the cover member 21 will be surely secured to the outer shell 5 and, as the result, it becomes sometimes possible not to use the adhesive or the duplex sticky tape to stick the cover member 21 to the outer shell 5.

As shown in FIG. 8*a*, formed in the hereinbefore described upper ventilator 9 is an air supply passage (hereinafter described as "upper air supply passage") 61, which leads the open air inhaled through the air inlet 25 of the cover member 21 to the air supply opening 54 of the impact-on-the head absorbing liner 11 via air supply opening 33 of the shutter member 22, air supply opening 43 and projected wall 49 of the air-inlet-and-outlet forming member 23 and air supply opening 51 of the outer shell 5. As shown in FIG. 8*a*, the upper air supply passage 61 communicates with the outside (the open air) at its foremost end (that is, the outer edge of the air inlet 25 of the cover member 21) and, near its rearmost end (that is, the inner edge of the air supply opening 54 of the liner 11), it communicates with the grooves 57 for air ventilation, which is formed in the inner surface of the liner 11. When the grooves 57 for air ventilation is omitted as hereinbefore described, the open air led to the rearmost end through the upper air supply passage 61 flows between the inner surface of the impact-on-the-head absorbing liner 11 and the hereinbefore described backing cover for the head (not shown) from the front side to the rear side thereof.

As indicated in chain line with one dot at C in FIG. 8*a*, the outer edge of the air inlet 25 (that is, the foremost end of the upper air supply passage 61) faces arrow D and does not open in a direction reverse of arrow D (that is, the outer edge of the air inlet 25 opens not in the rearward direction but in the forward direction), so that the passage 61 can serve to supply air. It is noted that the chain line C is a straight line that passes through both the upper end and the lower end of the air inlet 25. The upper air supply passage 61 closes when the air supply opening 43 of the air-inlet-and-outlet forming member 23 is closed by the pair of right and left fitting pins 24*a* and 24*b* of the shutter member 22.

As shown in FIG. 8*b*, formed also in the upper ventilator 9 is an air exhaust passage (hereinafter described as "upper air exhaust passage") 62 which leads the exhaust air inhaled through the lateral groove 56 of the impact-on-the-head absorbing liner 11 to the air exhaust opening 59, which is defined by the interrupted portions 27*a*, 27*b* of the cover member 21 and the outer surface of the outer shell 5, via longitudinal grooves 55*a*, 55*b* of the liner 11, projected walls 50*a*, 50*b* and air exhaust openings 48*a*, 48*b* of the air-inlet-and-outlet forming member 23, notches 38*a*,38*b* of the shutter member 22, and gap 58 defined by the inner surface of the cover member 21 and the outer surface of the air-inlet-and-outlet forming member 23 or the outer shell 5. It is noted that the air exhaust opening 59 is provided in a position far from the air inlet 25 of the upper air supply passage 61. As shown in FIG. 8*b*, the foremost end (that is, the lower edge of the lateral groove 56 of the impact-on-the-head absorbing liner 11) of the upper air exhaust passage 62 communicates with a portion near the upper part of the inner surface of the shield plate 4, and the rearmost end thereof (that is, the outer edge of the air exhaust opening 59) communicates with the outside (the open air).

As indicated in chain line with one dot at E in FIG. 8*b*, the outer edge of the air exhaust opening 59, the rearmost end of the upper air exhaust passage 62 does not face arrow D, which generally indicates the relative flow of the open air, but opens in the reverse direction of arrow D (that is, the outer edge of the opening 59 opens not in the forward direction but in the rearward direction), so that the passage 62 can serve to exhaust air. It is noted that the chain line E is a straight line passing through the tip of the interrupted portion 27*a*, 27*b* of the cover member 21 and perpendicular to the outer surface of the outer shell 5. The upper air exhaust passage 62 closes when the air exhaust openings 48*a* and 48*b* of the air-inlet-and-outlet forming member 23 are closed by the covering arms 36*a* and 36*b* of the shutter member 22, respectively. It is noted that the inclination angle of the outer edge of the air exhaust opening 59 (that is, the angle formed by arrow D and chain line E) is about 15° in FIG. 8*b* but, in view of its practice, it is preferable to be in the range of 5–40° and much preferable to be in the range of 10–30°.

Figure 11A:
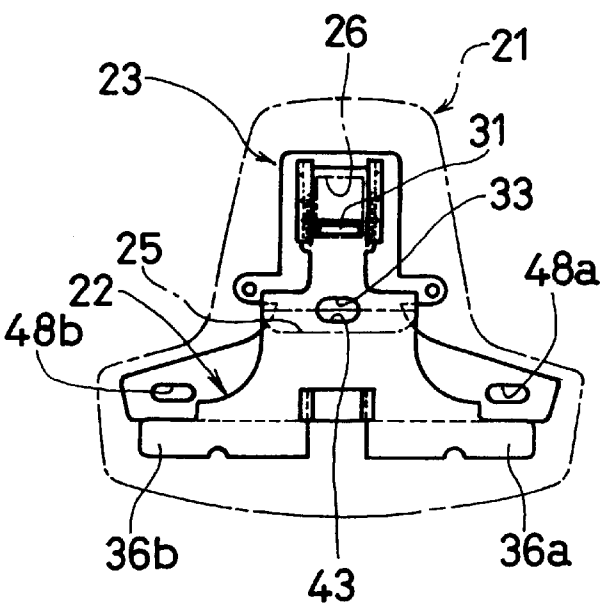
FIG. 11*a* is a front view, illustrating positional relationship, of the three parts of the upper ventilator of FIG. 2, when the shutter member is in its descended position.
Figure 11B:
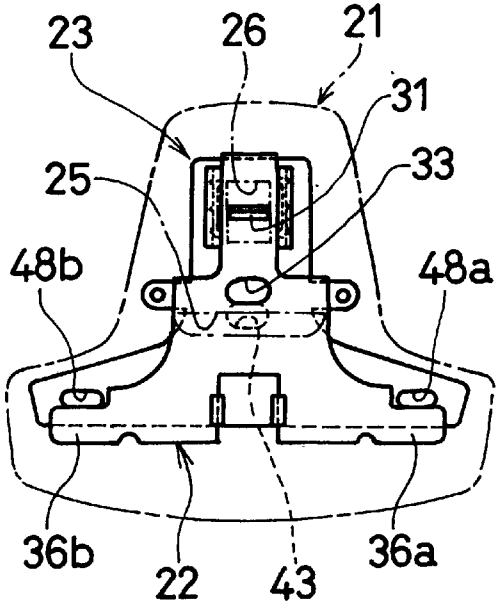
FIG. 11*b* is a front view, illustrating positional relationship, of the three parts, when the shutter member is in its intermediate position.
Figure 11C:
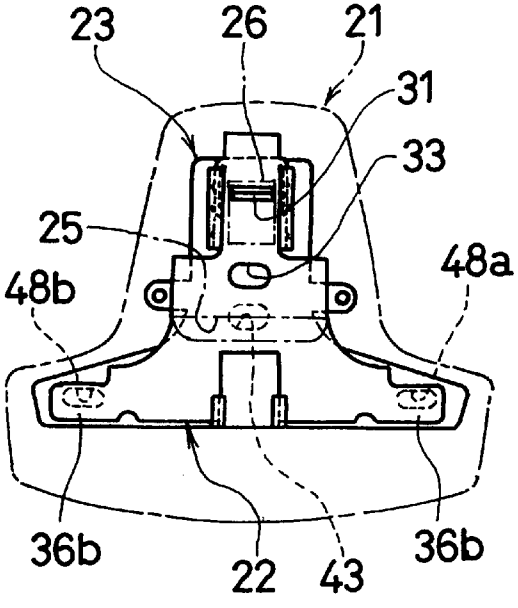
FIG. 11*c* is a front view, illustrating positional relationship, of the three parts, when the shutter member is in its ascended position.

In the hereinbefore described upper ventilator 9, when the operating tab 31 is picked with fingers to slide the shutter member 22 up and down, whereby the shutter member 22 is placed selectively in its upper position, its intermediate position, and its lower position, the protruding clicks 32*a* and 32*b* are engaged selectively with the upper recesses 42*a*, the intermediate recesses 42*b*, and the lower recesses 42*c* of the air-inlet-and-outlet forming member 23, so that the shutter member 22 can be kept in the three positions as shown in FIGS. 11*a*–11*c*. That is, in the first position in which the respective protruding clicks 32*a* and 32*b* are engaged with the pair of right and left lower recesses 42*c* (such a state as to be shown in FIGS. 8*a*, 8*b* and 11*a*), the shutter member 22 opens all of the air supply opening 43 and the air exhaust openings 48*a* and 48*b* of the air-inlet-and-outlet forming member 23, so that both the upper air supply passage 61 and the upper air exhaust passage 62 are opened. In the second position in which the respective protruding clicks 32*a* and 32*b* are engaged with the pair of right and left intermediate recesses 42*b* (such a state as to be show in FIG. 11*b*), the shutter member 22 closes the air supply opening 43 of the air-inlet-and-outlet forming member 23 but opens the air exhaust openings 48*a* and 48*b* thereof, so that the upper air supply passage 61 is closed and the upper air exhaust passage 62 is opened. Further, in the third position in which the respective protruding clicks 32*a* and 32*b* are engaged with the pair of right and left upper recesses 42*c* (such a state as to be shown in FIG. 11*c*), the shutter member 22 closes all of the air supply opening 43 and the air exhaust openings 48*a* and 48*b* of the air-inlet-and-outlet forming member 23, so that both the upper air supply passage 61 and the upper air exhaust passage 62 are closed.

Figure 4:
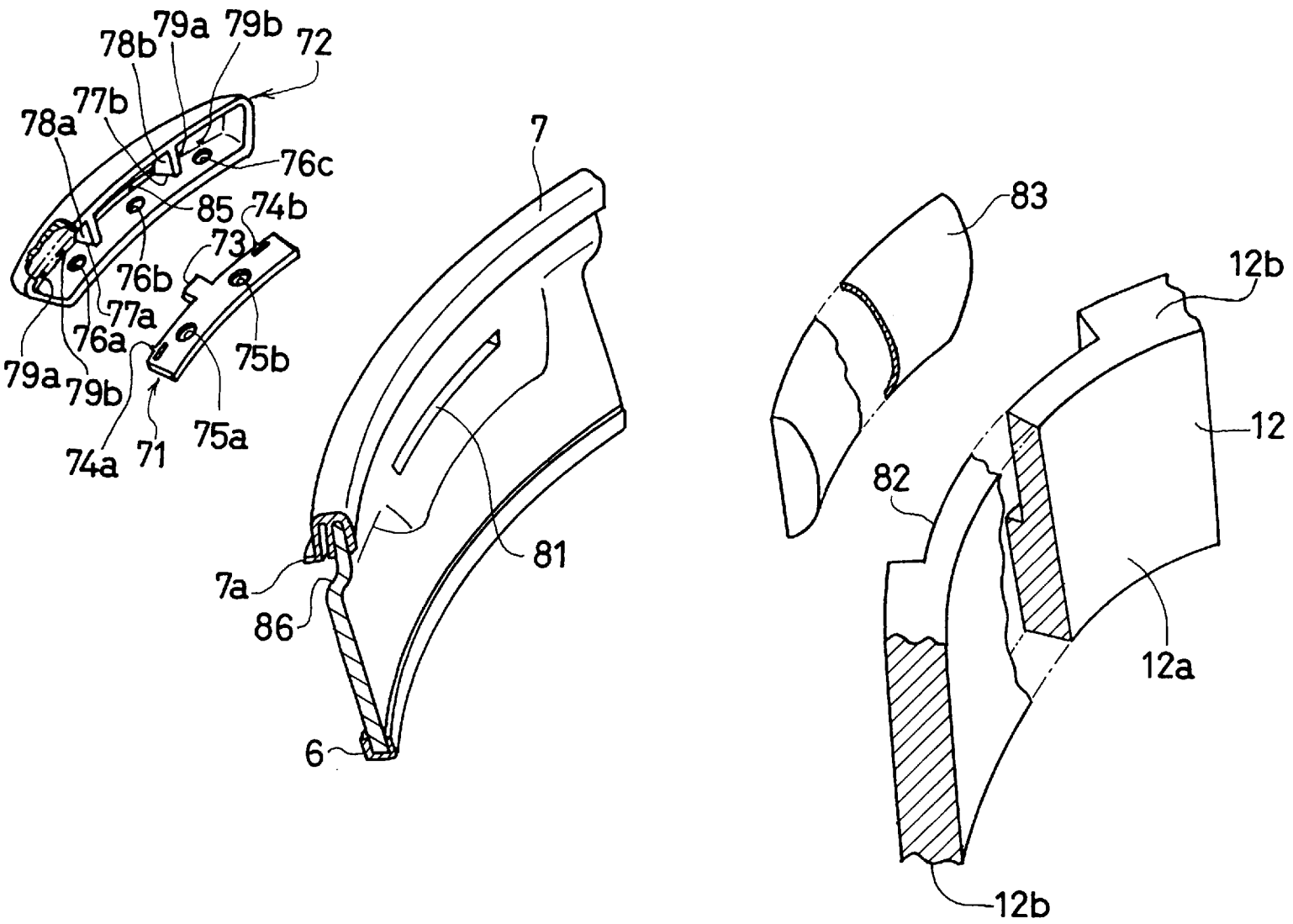
FIG. 4 is an exploded, perspective view, viewed from the rear side, of the lower ventilator and its circumference of FIG. 2.

As shown in FIGS. 2 and 4, the lower ventilator 10 has two lower ventilator forming members: a shutter member 71 and a cover member 72, which serves also as an air-inlet forming member. These two lower ventilator forming members may be made of the same materials having suitable elasticity and suitable rigidity, such as polycarbonate, ployacetal, ABS, nylon or other synthetic resin as those of the upper ventilator forming members. For example, the shutter member 71 and the cover member 72 may be all made of polycarbonate. Or the shutter member 71 may be made of polyacetal, ABS, or nylon and the cover member 72 may be made of polycarbonate. For example, the shutter member 71 is of substantially horizontal plate and, on the respective right and left sides of the shutter member 71, air inlets 75*a* and 75*b* are formed. Further, an operating tab 73 is formed integrally with the shutter member 71 so as to protrude from the central front portion thereof and a pair of protruding clicks 74*a*, 74*b* are formed integrally with the shutter member 71 at the front end thereof on the respective right and left sides of the operating tab 73.

As shown in FIGS. 2 and 4, the cover member 72 is, for example, of substantially laterally long cup-shape and, in the lower wall thereof, air supply openings 76*a*, 76*b* and 76*c* are formed so that two of the three openings, adjacent to each other, may be capable of corresponding to the respective inlets 75*a* and 75*b* of the shutter member 71. Further, in the inside of the cover member 72, partition walls 78*a* and 78*b* are formed integrally with the cover member 72, and have each a cutout 77*a*, 77*b* on the lower side thereof. Moreover, in the inside of the cover member 72, each of the outer sides of the partition walls 78*a* and 78*b* has a pair of recesses 79*a* and 79*b* to be engaged with the protruding clicks 74*a*, 74*b*, and an opening 85 for inserting the operating tab 73 is provided in the lower part of the central front portion of the cover member 72 so as to correspond to the operating tab 73.

As shown in FIGS. 2 and 4, in a part of an area, which corresponds to the rider or the like's chin, and its circumference of the outer shell 5, an air supply opening 81, for example, substantially laterally long slit is formed so as to face the cover member 72 and, in the outer shell 5, a depressed portion 86 is also formed to surround the air supply opening 81. As shown in FIGS. 4 and 5, in the central upper portion of the impact-on-the-chin absorbing liner 12, a substantially laterally long recess portion 82 for air supply, which is depressed out of both the outer surface 12*c* and the upper side surface 12*b* of the liner 12 (hereinafter described as "depressed portion"), is formed to correspond to the depressed portion 86 and, in the recess portion 82, an air guide plate 83, for example, shaped into a substantially laterally long dish-like form is stuck to the liner 12 with an adhesive so that its concave may become the front surface thereof. Further, in the right and left portions of the impact-on-the-chin absorbing liner 12, a pair of right and left fitting apertures 84*a* and 84*b* are formed, respectively, and the respective end portions of a pair of right and left chin straps (not shown) are fitted into the fitting apertures 84*a* and 84*b*.

The procedure of assembling the two lower-ventilator forming members (that is, the shutter member 71 and the cover member 72 which serves also as the air-inlet forming member) onto the cap body 2 as shown in FIG. 9 may be performed in the following numeral order.

(1) The shutter member 71 is inserted into the cover member 72 along the inner surface of the lower wall of the cover member 72 through the rear side thereof until the shutter member 71 is fitted into the pair of right and left guide cutouts 77*a* and 77*b* of the cover member 72 and the operating tab 73 of the shutter member 71 protrudes from the opening 85 of the cover member 85.

(2) After applying an adhesive or the like to the rear side, being to be stuck, of the cover member 72, the rear side is pressed against the depressed portion 86 of the outer shell 5. Thus, the cover member 72, which has been put together with the shutter member 71, can be secured to the outer shell 5.

As shown in FIG. 9, formed in the hereinbefore described lower ventilator 10 is an air supply passage (hereinafter described as "lower air supply passage") 87 which leads the open air inhaled through a recess 88, which yields between the inclined outer surface of the depressed portion 86 of the outer shell 5 and the lower wall of the cover member 72 and, for example, has a substantially laterally long shape, to an inner space of the air guide plate 83 via air supply openings 76*a*, 76*b*, 76*c* of the cover member 72, air inlets 75*a*, 75*b* of the shutter member 71, the inner space of the cover member 72, and air supplying opening 81 of the outer shell 5. As shown in FIG. 9, the foremost end of the lower air supply passage 87 (that is, the outer edge of the substantially laterally long recess 88 that yields between the inclined outer surface of the depressed portion 86 of the outer shell 5 and the lower wall of the cover member 72) communicates with the outside (the open air), and the rearmost end thereof (that is, a portion near the upper end of the space provided by the concave of the air guide plate 83) communicates with the lower portion or its circumference of the inner side of the shield plate 4.

As indicated in chain line with one dot at F in FIG. 9, the outer edge of the recess 88 (that is, the foremost end of the lower air supply passage 87) faces arrow D, which generally indicates the relative flow of the open air, and does not open in a direction reverse of arrow D (that is, the foremost end opens not in the rearward direction but in the forward direction), so that the passage 87 can serve to supply air. It is noted that the chain line F is a straight line passing through the front edge of the lower wall of the cover member 72 and perpendicular to the outer surface (concretely, the outer surface of the depressed portion 86) of the outer shell 5. The lower air supply passage 87 closes when the shutter member 72 closes the air supply openings 76*a* and 76*b*.

To attach the cover member 72 firmly to the outer shell 5, the same fitting pins as the pins 24*a*–24*d* of the cover member 21 of the upper ventilator 9 may be provided in the cover member 72, and fitting apertures corresponding to the fitting pins of the cover member 72 may be provided in the outer shell 5, as the fitting apertures 53*a*–53*d* have been provided.

In the hereinbefore described lower ventilator 10, when the operating tab 73 is picked with fingers to slide the shutter member 71 right and left, whereby the protruding clicks 74*a* and 74*b* of the shutter member 71 are engaged selectively with the pair of right recesses 79*a* or the pair of left recesses 79*b* of the cover member 72, it is possible to place the shutter member 71 in either of two positions: that is, in a first position where the pair of protruding clicks 74*a* and 74*b* are engaged with the pair of right recesses 79*a* (that is, a state shown in FIG. 9), the air inlets 75*a* and 75*b* of the shutter member 71 coincide with the respective air supply openings 76*a* and 76*b* of the cover member 72, and the left end of the shutter member 71 does not cover the opening 76*c*, so that the lower air supply passage 87 becomes in the opened state, while in a second position where the pair of protruding clicks 74*a* and 74*b* are engaged with the pair of left recesses 79*b*, the shutter member 71 covers the opening 75 with its central part and the openings 76*a* and 76*c* with its right and left parts, respectively, so that the lower air supply passage becomes in the closed state.

The full-face-type helmet 1 hereinbefore described by reference to FIGS. 1–11 may be used by the rider or the like as follows.

When the rider or the like puts the cap body 2 on his head and holds the shield plate 4 in its backward position to close the window opening 3, the following six cases I–VI shown in Table 1 arise in corresponding to both the positions of the shutter member 22 of the upper ventilator 9 and the shutter member 71 of the lower ventilator 10.

TABLE 1

| | | Position of the shutter member 22 of the upper ventilator 9 | | |
|---|---|---|---|---|
| | | 1st | 2nd | 3rd |
| Position of the shutter member 71 of the lower ventilator 10 | 1st | I | III | V |
| | 2nd | II | IV | VI |

According to Table 1, the lower air supply passage 87 opens in Cases I, III and V and closes in Cases II, IV and VI, so that in Cases I, III and V, an air stream 91 flowing in the lower air supply passage 87 and indicated in chain line with two dots in FIG. 9 is effectively obtained. Thus, the air flows from underneath to above in the inside of the shield plate 4 but, in Cases II, IV and VI, the air stream 91 can not flow like that.

According to Table 1, the upper air supply passage 61 opens in Cases I and II and closes in Cases III, IV, V and VI, so that in Cases I and II, an air stream 92 flowing in the upper air supply passage 61 and indicated in chain line with two dots in FIG. 8*a* is effectively obtained. Thus, the inside of the cap body 2 can have good ventilation but, in Cases III, IV, V and VI, the air stream 92 can not flow like that.

According to Table 1, the upper air exhaust passage 62 opens in Cases I, II, III and IV and closes in Cases V and VI, so that in Cases I, II, III and IV, an air stream 93 flowing in the upper air exhaust passage 62 and indicated in chain line with two dots in FIG. 8*b* is effectively obtained. Thus, the air ascending in the inside of the shield plate 4 is effectively led to the outside and it becomes possible to flow the air smoothly in the inside of the shield plate 4 but, in Cases V and VI, the air stream 93 can not flow like that.

In the following Table 2, a correlation of the six cases, Cases I–VI given in Table 1 with the defogging action on the shield plate 4 and the ventilating action on the inside of the cap body 2 will be shown.

TABLE 2

| Case | I | II | III | IV | V | VI |
|---|---|---|---|---|---|---|
| Defogging action | high | slightly high | high | slightly low | slightly low | low |
| Ventilating action | high | slightly high | slightly low | slightly low | slightly low | low |

Thus, the state brought by Case I is suitable for the summer season of high temperature and high humidity and the state brought by Case VI is suitable for the winter season of low temperature and low humidity. The states brought by Cases II–V can be selected, if necessary, when the temperature and the humidity are intermediate and, particularly, the state brought by Case III is suitable for wintry rainy days of low temperature and high humidity.

Having described a specific preferred embodiment of the present invention with reference to the accompanying drawings, it is to be understood that the invention is not limited to that precise embodiment, and that various changes and modifications may be effected therein by one skilled in the art without departing from the scope or spirit of the invention as defined in the appended claims.

In the above embodiment, the shutter member 22 can be held in any of the first to third positions but may be capable of being held in a fourth position, for example, provided between the second position and the third position. That is, when held in the fourth position, the shutter member 22 may open the air supply opening 43 of and close the air exhaust openings 48*a* and 48*b* of the air-inlet-and-outlet forming member 23 so as to open the upper air supply passage 61 and to close the upper air exhaust passage 62. Further, the shutter member 22 may be held in a position in which the air supply opening 43 and/or the air exhaust openings 48*a* and 48*b* of the air-inlet-and-outlet forming member 23 are halfopened and, similarly, the shutter member 71 may be held in a position in which the air supply openings 76*a*, 76*b*, 76*c* of the cover member 72 are halfopened. The respective shapes of the air-inlet-and-outlet forming member 23, the shutter members 21 and 71, the cover members 21 and 72 and so forth are not limited to the illustrated embodiment but arbitrarily variable. Particularly, so long as the shutter member 22 can move to open and close the air supply opening 43 and the air exhaust openings 48*a* and 48*b* of the air-inlet-and-outlet forming member 23, the air supply opening 33 and/or the notches 38*a* and 38*b* for exhausting the air can be omitted, if necessary.

In the above embodiment, the rearmost end of the air exhaust passage 62 is the gap which is defined by the interrupted portion 27*a*, 27*b* of the cover member 21 and the outer surface of the cap body 2, but it may be an air exhaust opening provided in the cover member 21, or a gap defined by the cover member 21 and any member other than the cap body 2.

In the above embodiment, the shutter member 22 is arranged between the cover member 21 and the air-inlet-and-outlet forming member 23, but the air-inlet-and-outlet forming member 23 and the shutter member 22 may be changed with each other so that the air-inlet-and-outlet forming member 23 may be arranged between the cover member 21 and the shutter member 22.

What is claimed is:

1. A helmet comprising:

a cap body, a shield plate attached to the cap body so as to cover at least partially an area which is positioned opposite to the face of a person with the helmet on, and means forming in said cap body an air exhaust passage, the foremost end of which is near the upper end of the inner surface of the shield plate, and the rearmost end of which is near an area positioned opposite to the forehead of the person with the helmet on and above the foremost end, wherein the air flows from the foremost end toward the rearmost end, and wherein the rearmost end of the air exhaust passage faces toward the rear side of said helmet, means forming in said cap body an air supply passage, the rearmost end of which is near an area of the inside of the cap body, is further provided in the cap body, wherein the air flows from the foremost end toward the rearmost end, and wherein the foremost end of the air supply passage faces toward the front side of said helmet, the area positioned opposite to the forehead of the person with the helmet on, and wherein both the air exhaust passage and the air supply passage can open and close with a common shutter member.

2. A helmet according to claim 1, wherein:

the cap body is full-face-type, a second air supply passage, the rearmost end of which is near the lower end of the inner surface of the shield plate, is further provided in the cap body, and wherein the air flows from the foremost end toward the rearmost end, and wherein the second air supply passage can be opened and closed by a second shutter member.

3. A helmet comprising:

means forming an air exhaust passage having a first foremost end in the inside of a cap body and a first rearmost end near to the outside of the cap body, wherein the air flows from the first foremost end toward the first rearmost end;

means forming an air supply passage having a second foremost end near to the outside of the cap body and a second rearmost end in the inside of the cap body, wherein the air flows from the foremost end toward the rearmost end, wherein the first rearmost end of the air exhaust passage is near to the second foremost end of the air supply passage and wherein both the air exhaust passage and the air supply passage can open and close with a common shutter member which is near to the first rearmost end of the air exhaust passage; and means by which the shutter member can be held at least in three positions, in the first position thereof, both the air exhaust passage and the air supply passage are opened, in the second position thereof, the air exhaust passage is opened, while the air supply passage is closed, and in the third position thereof, both the air exhaust passage and the air supply passage are closed.

4. A helmet according to claim 3, wherein:

an air-inlet-and-outlet forming member, the shutter member, and a cover member are attached to the cap body, an air exhaust opening which constitutes a part of the air exhaust passage and an air supply opening which constitutes a part of the air supply passage are provided in the air-inlet-and-outlet forming member, the shutter member is movable in relative relation with the air-inlet-and-outlet forming member to open and close the air exhaust opening and the air supply opening, and the cover member covers at least the air exhaust opening so as to constitute at least a part of the rearmost end of the air exhaust passage.

5. A helmet according to claim 4, wherein: the first rearmost end of the air exhaust passage is a gap defined by the cover member and the outer surface of the cap body.

6. A helmet according to claim 5, wherein: the angle of inclination of the outer edge of the air exhaust opening, which comprises the gap and is the rearmost end of the air exhaust passage to the moving direction D, which generally indicates the relative flow or the open air, is within the range of 10–30°.

7. A helmet according to claim 5, wherein: the angle of inclination of the outer edge of the air exhaust opening which comprises the gap and is the rearmost end of the air exhaust passage, to the moving direction D, which generally indicates the relative flow of the open air, is within the range of 5–40°.

8. A helmet comprising:

a cap body, a shield plate attached to the cap body so as to cover at least partially an area which is positioned opposite to the face of a person with the helmet on, and means forming in said cap body an air exhaust passage, the foremost end of which is near the upper end of the inner surface of the shield plate, and the rearmost end of which is near an area positioned opposite to the forehead of the person with the helmet on, and wherein the air flows from the foremost end toward the rearmost end, means forming in said cap body an air supply passage, the rearmost end of which is near an area of the inside of the cap body, is further provided in the cap body, and wherein the air flows from the foremost end toward the rearmost end, the area positioned opposite to the forehead of the person with the helmet on, wherein both the air exhaust passage and the air supply passage can open and close with a common shutter member, and means by which the shutter member can be held at least in three positions, in the first position thereof, both the air exhaust passage and the air supply passage are opened, in the second position thereof, the air exhaust passage is opened, while the air supply passage is closed, and in the third position thereof, both the air exhaust passage and the air supply passage are closed.

* * * * *